United States Patent [19]

Anschütz

[11] 4,242,826

[45] Jan. 6, 1981

[54] FIREARM

[76] Inventor: Elfi Anschütz, Schwalbenweg 79, D 7900 Ulm/Donau, Fed. Rep. of Germany

[21] Appl. No.: 906,750

[22] Filed: May 17, 1978

[30] Foreign Application Priority Data

May 23, 1977 [DE] Fed. Rep. of Germany ..... 2723110

[51] Int. Cl.[3] ..... F41C 23/00

[52] U.S. Cl. ..... 42/73

[58] Field of Search ..... 42/75 A, 73, 72, 71 R

[56] References Cited

U.S. PATENT DOCUMENTS

| | | | |
|---|---|---|---|
| 1,585,249 | 5/1926 | Johns | 42/71 R |
| 2,498,749 | 2/1950 | Benson | 42/71 R |
| 2,787,855 | 4/1957 | Guymon | 42/73 |
| 2,826,848 | 3/1958 | Davies | 42/71 R |
| 2,952,934 | 9/1960 | Yovanovitch | 42/73 |
| 3,875,694 | 4/1975 | Wild | 42/73 |

*Primary Examiner*—Charles T. Jordan

*Attorney, Agent, or Firm*—Hammoind & Littell, Weissenberger and Muserlian

[57] ABSTRACT

This invention is directed to a firearm comprising a barrel, a receiver, and a stock wherein the stock is comprised of a main stock and a forestock and the forestock is movable in a plane parallel to the axis of the barrel or is pivotable about the barrel, or both, and is fixable in each of its possible positions relative to the barrel.

5 Claims, 5 Drawing Figures

FIREARM

Figure 1:
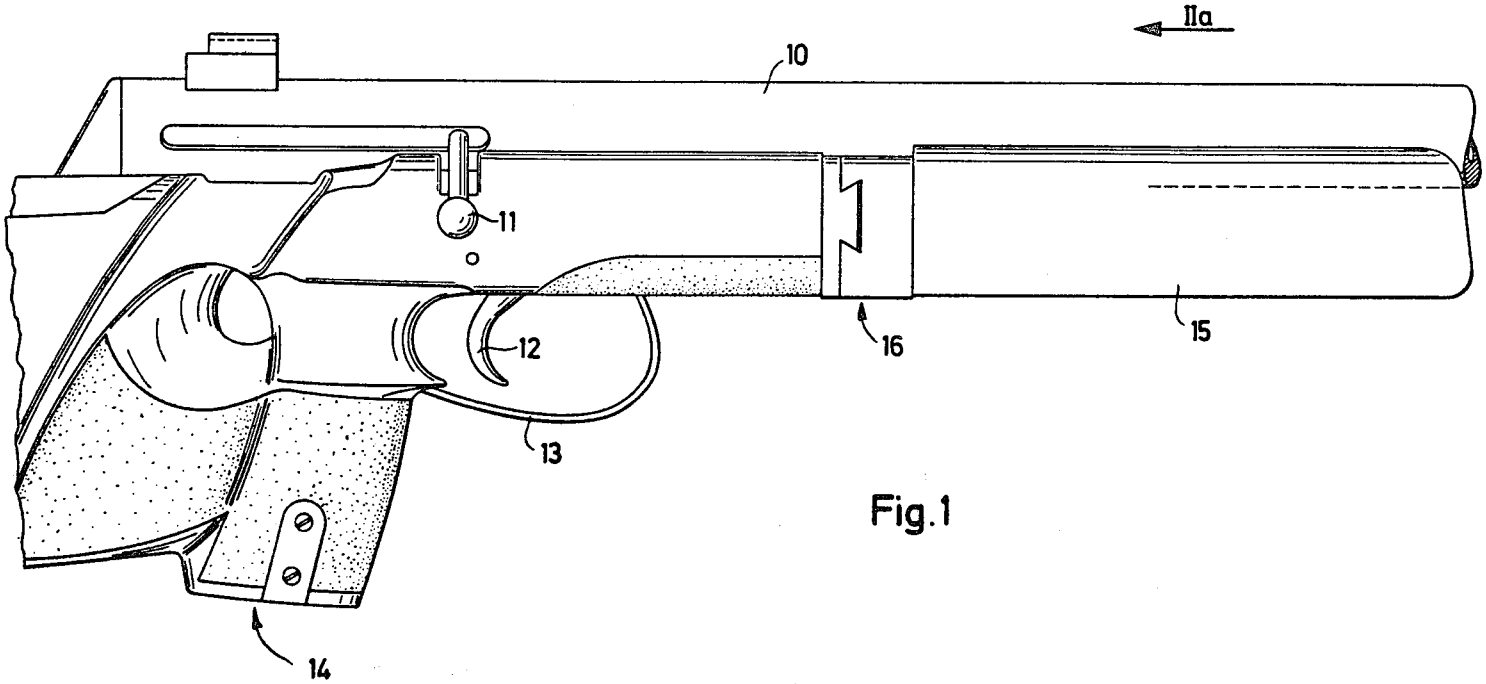

The invention relates to a firearm having a forestock movable about the barrel and fixable in each of its possible positions relative to the barrel.

In the case of such firearms, in particular competitive arms, it is desirable to adapt the weapon to the respective anatomical conditions of the marksman and his needs for the respective type of competition. For this purpose are known in particular stock caps adjustable in all directions, which form the rear end of the stock and serve for proper support of the firearm on the marksman's shoulder. For the forestock only a hand stop adjustable in its position or an adjustable sling swivel for use of a sling is known.

It is the object of the invention to propose further adjustment possibilities for adaptation to the anatomical conditions of the individual marksman or respectively to the respective type of competition. This problem is solved by the invention herein.

The firearm of this invention consists of a barrel, system and stock, the barrel and system being connected with the stock, preferably made of wood. The stock is divided into two parts, the main stock and the forestock. The firearm is characterized in that the forestock is movable toward and away from the barrel in a plane containing the axis of the barrel and/or is movable back and forth in a plane parallel to the axis of the barrel and/or is pivotable about the barrel or about its own axis and is fixable in each of its possible positions relative to the barrel. The forestock and the main stock, the forestock and the system, and/or the forestock and the barrel may be connected by a pivoting guide, such as a dovetail guide. If the pivoting guide is a dovetail guide, the guide may have a clamping jaw engaging the guide. A pivoting guide connecting the forestock and barrel may pivot the forestock along a circular path that has its center on the bore axis of the barrel.

It is seen that here the forestock is movable in all directions or respectively in all planes. It can be displaced along the barrel, pivoted about the barrel, moved back and forth laterally under the barrel, and lastly moved toward and away from the barrel. These adjustment possibilities can moreover be applied in combination with one another or overlapping one another.

This gives the marksman further possibilities of variation to attain optimum adaptation of the stock to his anatomical conditions or to the respective types of competition. This is of considerable advantage for example when, shooting from a standing position, the marksman has a tilted basic firing position from the shoulder. This firing position, therefore, need not be accepted also at the forestock. Instead, the latter may be adjusted so that despite the tilt of the main portion of the stock its longitudinal median plane will become a vertical plane containing the bore axis of the barrel. The equivalent applies to shooting from a kneeling position. When shooting from a lying position, it was necessary with the conventional rigid forestock to accept that the points of support of the firearm defined by the marksman's elbows are close together. This results from the fact that for the optimum firing position the lower arm bones of the left hand gripping the forestock should lie in the longitudinal median plane of the forestock. Now if the forestock is no longer rigid, but adjustable in all directions, this condition can be fulfilled also when this longitudinal median plane of the forestock is no longer a vertical plane. In this way it is possible to diverge the points of support, namely the points of the marksman's elbows resting on the support. It is easy to make the adjustment. It permits a wide variety of adaptations to the needs of the marksman. Lastly it reduces the cost of manufacture, because the forestock can now be made of a separate part. Thus smaller pieces of wood may be used for the main stock. Possibly even, depending on the design, the forestock can be made from waste from the regular stock manufacture.

Many possibilities exist for making the forestock pivotable. For instance, the stock may be divided into two parts. These two parts can then be connected by a pivotal guide, a longitudinal guide, a cross guide or vertical guide. Optionally one of the parts is subdivided further. The forestock may comprise more than one part, such as two parts. One part of the forestock may be movable in a guide in the direction of the axis of the barrel along the barrel and may be fixable in any possible relative position along the barrel. The guide comprises a rod, such as a cylindrical rod, which may be secured to a part of the forestock and which may traverse a guide opening at the other part of the forestock. The attachment of the rod may be releasable at a part of the forestock and adjustable along a guide, such as an arc-of-circle guide or a straight guide lying crosswise to the barrel axis. One part of the forestock may comprise a vertical guide in addition to the longitudinal guide along the barrel. The movable part of the forestock may be divided into two parts, where one part is a slide movable in the longitudinal guide, while the other is a grip part displaceable on the vertical guide supported by the slide and consisting of two parallel rods normal to the barrel axis. Instead of the subdivision of the forestock, another possibility is to provide the forestock with the stated guides relative to the system.

To engineer the various guides or fixed positions the specialist has many possibilities of construction. The guides comprise prismatic guide tracks with undercuts, angular or cylindrical rods or other known guide elements, on which move correspondingly formed counter-guides of the guided part. Fixation occurs by clamping jaws or clamping screws. Relatively movable parts can be connected or fixed by the action of reciprocally grooved plates. Such plates can be moved apart for adjustment and can be brought into engagement for fixation through clamping screws or the like.

In the drawing, the invention is explained with reference to a simple pivoting guide.

Figure 2A:
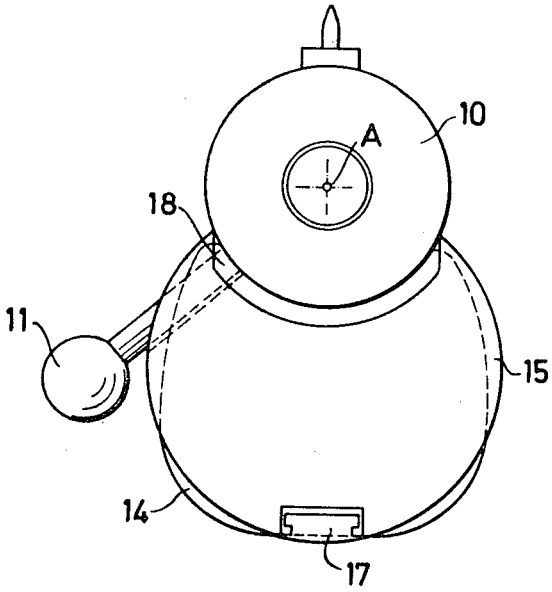
Figure 2B:
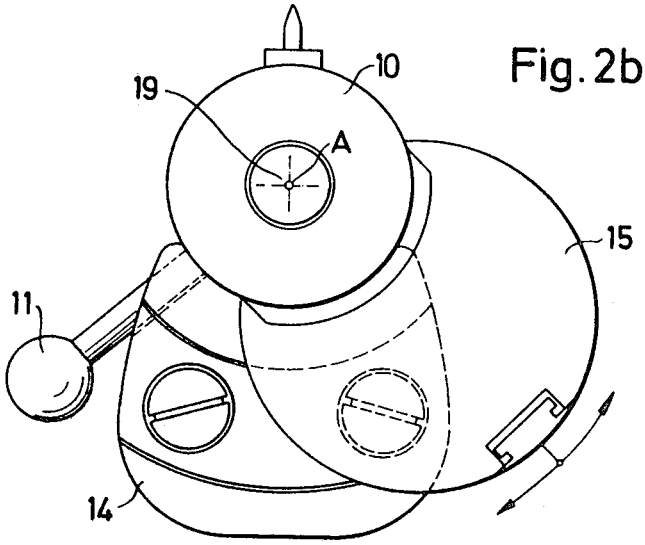
Figure 3:
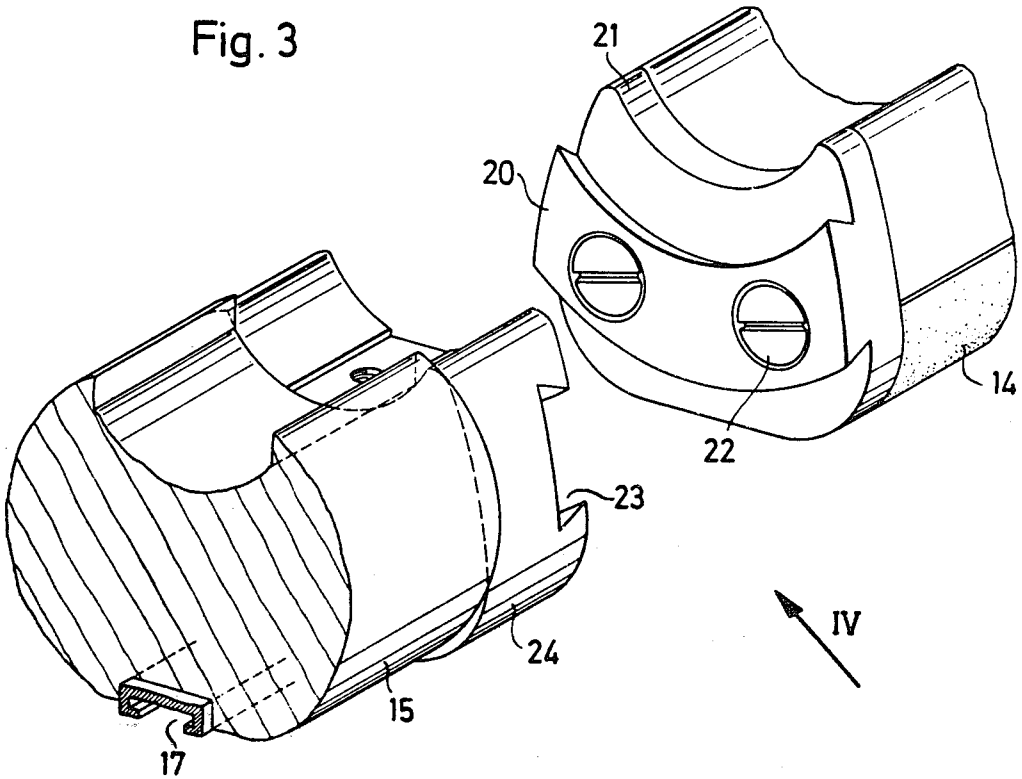
Figure 4:
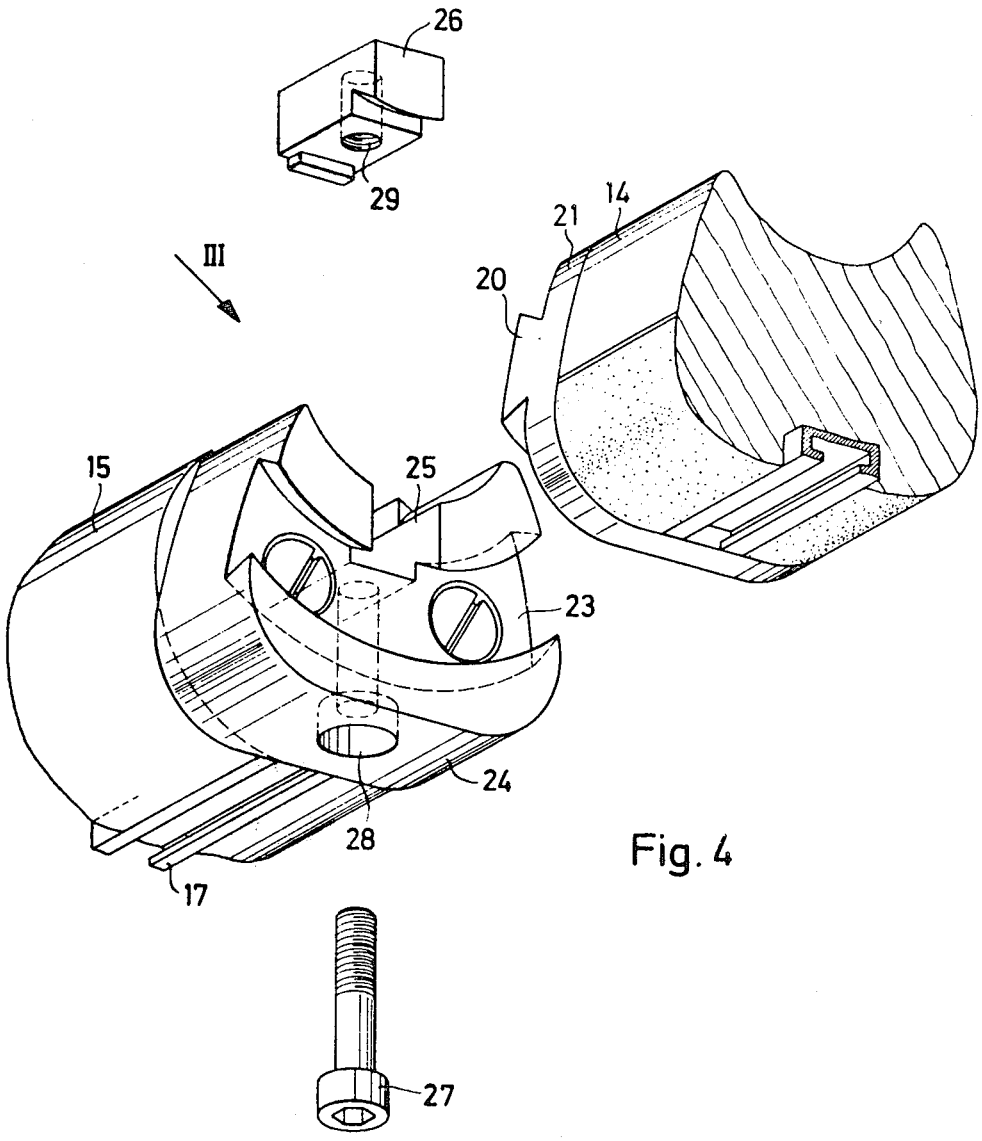

FIG. 1 is a side view, broken off at the rear and front ends, of a firearm with adjustable forestock;

FIG. 2*a*, a front view of the firearm, where the longitudinal median plane of the forestock lies in a vertical plane;

FIG. 2*b*, a view corresponding to FIG. 2*a*, with the forestock pivoted out of the vertical plane;

FIG. 3, viewed in direction III of FIG. 4, a perspective view of the front end of the main stock and of the rear end of the forestock, and FIG. 4, partly as an exploded view and partly in perspective, a view similar to FIG. 3 viewed in direction IV of FIG. 3.

FIG. 1 shows a firearm with a barrel 10 indicated only schematically, a breech lever 11, trigger 12 and trigger guard 13. The stock is divided into two parts. It consists of the main stock 14, which is designed according to the needs of the marksman, in the example shown, the competitive marksman, and the forestock 15. At the front end of main stock 14 and respectively at the rear end of forestock 15, a part of a pivoting guide 16 is secured.

FIG. 2*a* shows a front view of the barrel 10 with forestock 15 and the usual track 17 provided therein for use of a hand stop or of the sling guard of a firing sling, both of which are not shown in the figure. The forestock 15 comprises at the top a depression 18 so that the barrel 10 can swing freely, this being important for precision in shooting. The forestock 15 is brought close to the barrel only laterally in such a way that the impression of a firm support of the forestock flanges raised on either side of the depression 18 at the barrel 10 is created. But rather than here, the actual attachment of the forestock occurs at the front end of main stock 14.

FIG. 2*b* shows the forestock 15 in a laterally pivoted position. The two possible pivoting directions are indicated by arrows. Pivoting occurs along a circular path whose center lies on the bore axis 19 of barrel 10.

FIGS. 3 and 4 show more clearly details of the pivot guide 16. It consists of two castings. One casting 21 having a dovetail tongue 20 is connected with main stock 14 through fastening screws 22. In the same manner a casting 24 having a dovetail groove 23 is connected with the forestock 15.

As can be seen more clearly in FIG. 4, casting 24 has on its top side, that is, the side toward the barrel 10, a recess 25 into which is fitted a clamping jaw 26. Clamping jaw 26 has sufficient play in the recess to be movable toward and away from the barrel 10. This is done with the aid of a clamping screw 27 which is passed from below through a corresponding bore 28 in casting 24 and engages by its threaded section in a threaded bore 29 of the clamping jaw 26. The section of the clamping jaw turned toward main stock 14 is designed so that it can form a part of the dovetail groove 23.

By turning the clamping screw 27 to the right, the clamping jaw is pulled away from barrel 10 into the dovetail groove 23. It thus contacts on the upper bevel of the dovetail tongue 20 when the latter is inserted in the dovetail groove 23. In this manner the relative position just then existing between forestock 15 and main stock 14 is fixed. Turning the clamping screw 27 to the left moves the clamping jaw 26 in recess 25 away from the dovetail groove 23, so that now a pivotal displacement of the forestock is possible.

Naturally, besides the pivoting of the forestock, it is possible also simply to use different forestocks interchangeably in the above explained design.

If it appears desirable, the forestock is moreover secured to the main stock also displaceable axially. It may then be advisable to divide the stock into more than two, more particularly three, parts. With regard to form and material of the forestock, the respective purpose of use is determining. Instead of a forestock of wood, one of plastic is well suitable, because with it the pivoting guide can be firmly and durably connected already during the manufacturing process in the mold, without a separate operation.

I claim:

1. A firearm comprising a barrel, a receiver, and a stock wherein the stock is divided into a main stock and a forestock connected by a pivoting guide which establishes a pivoting of the forestock along a circular path, the center of said circular path being coincident with the bore axis of the barrel, and wherein the forestock is fixable in each of its positions relative to the barrel.

2. The firearm of claim 1 wherein the pivoting guide is a dovetail guide.

3. The firearm of claim 2 wherein a fixing means engages the dovetail guide.

4. The firearm of claim 3 wherein the fixing means is a clamping jaw.

5. The firearm of claim 1 wherein each relatively movable part has a grooved plate and the plates can be moved apart for adjustment and can be brought into engagement for fixation by a fixing means.

* * * * *